US006952641B2

(12) United States Patent
DiDomenico et al.

(10) Patent No.: US 6,952,641 B2
(45) Date of Patent: Oct. 4, 2005

(54) SOFTWARE ARCHITECTURE OF AN INTEGRATED HOST SYSTEM FOR SENSED VEHICLE DATA

(75) Inventors: John DiDomenico, Tucson, AZ (US); Brett J. Morien, Tucson, AZ (US); Craig S. Rendahl, Tucson, AZ (US); Raghunandan Agaram, Tucson, AZ (US)

(73) Assignee: SPX Corporation, Charlotte, NC (US)

( * ) Notice: Subject to any disclaimer, the term of this patent is extended or adjusted under 35 U.S.C. 154(b) by 352 days.

(21) Appl. No.: 10/164,073

(22) Filed: Jun. 7, 2002

(65) Prior Publication Data

US 2003/0043057 A1 Mar. 6, 2003

Related U.S. Application Data

(63) Continuation-in-part of application No. 09/931,774, filed on Aug. 20, 2001, now abandoned.

(51) Int. Cl.[7] ..... G06G 7/70

(52) U.S. Cl. ..... 701/111; 701/102; 701/114; 701/115

(58) Field of Search ..... 701/102, 111, 701/114, 115

(56) References Cited

U.S. PATENT DOCUMENTS

| | | | |
|---|---|---|---|
| 3,696,247 A | 10/1972 | McIntosh et al. | 250/83.3 H |
| 3,811,776 A | 5/1974 | Blau, Jr. | 356/51 |
| 3,957,372 A | 5/1976 | Jowett et al. | 356/51 |
| 3,958,122 A | 5/1976 | Jowett et al. | 250/346 |
| 3,973,848 A | 8/1976 | Jowett et al. | 356/51 |
| 4,012,144 A | 3/1977 | Hedelman | 356/73 |
| 4,013,260 A | 3/1977 | McClatchie et al. | 250/343 |

(Continued)

OTHER PUBLICATIONS

Zhang, Yi, Stedman, Donald H., Bishop, Gary A., Beaton, Stuart P., and Guenther, Paul L.; "Worldwide On–Road Vehicle Exhaust Emissions Study by Remote Sensing"; Environmental Science & Technology 1995;vol. 29#9. pp. 2286–2294.

Glover, Edward L., Mickelsen, Jan and McClement Dennis; Evaluation of Methods to Determine Catalyst Efficiency in the Inspection/Maintenance Process; Society of Automotive Engineers; SAE#9600092.

Butler, James, Gierczak, Christine and Liscombe Paula; "Factors Affecting the NDIR Measurement of Exhaust Hydrocarbons"; Coordinating Research Council 1995; pp. 4–171 & 4–190.

Mackay, Gervase I., Nadler, S. Don, Karecki, David R., Schiff, Harold I., Butler, James W., Gierczak, Christine A. and Jesion, Gerald; "Final Phase 1b Report to the CRC and NREL for Research Performed Under Agreement No. VE–8–2"; Coordinating Research Council 1994.

Peterson, James E. and Stedman, Donald H.; "Find and Fix the Polluters"; Chemtech 1992, pp. 47–53.

Bishop, Gary A. and Stedman Donald H.; "Infrared Emissions and Remote Sensing"; Journal of Air and Waste Management Assoc. 1992; vol. 42#5, pp. 695–697.

(Continued)

*Primary Examiner*—Henry C. Yuen
*Assistant Examiner*—Johnny H. Hoang
(74) *Attorney, Agent, or Firm*—Baker & Hostetler, LLP

(57) ABSTRACT

A system for processing sensed vehicle data includes a sensor for sensing data related to at least one characteristic of a passing vehicle and a host unit that receives sensed data from the sensor. The sensor and the host unit are integrated into a single housing. The host stores data and communicates with peripheral devices and/or with a central processing facility.

33 Claims, 5 Drawing Sheets

U.S. PATENT DOCUMENTS

| | | | | |
|---|---|---|---|---|
| 4,160,373 | A | 7/1979 | Fastaia et al. | 73/23 |
| 4,171,909 | A | 10/1979 | Kramer et al. | 356/73 |
| 4,204,768 | A | 5/1980 | N'guyen | 356/243 |
| 4,310,249 | A | 1/1982 | Kramer | 356/414 |
| 4,348,732 | A | 9/1982 | Kreft | 364/571 |
| 4,372,155 | A | 2/1983 | Butler et al. | 73/114 |
| 4,390,785 | A | 6/1983 | Faulhaber et al. | 250/330 |
| 4,432,316 | A | 2/1984 | Ogita | 123/328 |
| 4,490,845 | A | 12/1984 | Steinbruegge et al. | 382/1 |
| 4,560,873 | A | 12/1985 | McGowan et al. | 250/339 |
| 4,602,160 | A | 7/1986 | Mactaggart | 250/341 |
| 4,632,563 | A | 12/1986 | Lord, III | 356/437 |
| 4,638,345 | A | 1/1987 | Elabd et al. | 357/24 |
| 4,663,522 | A | 5/1987 | Welbourn et al. | 250/223 R |
| 4,678,914 | A | 7/1987 | Melrose et al. | 250/343 |
| 4,687,934 | A | 8/1987 | Passaro et al. | 250/343 |
| 4,710,630 | A | 12/1987 | Kuppenheimer, Jr. et al. | 250/353 |
| 4,746,218 | A | 5/1988 | Lord, III | 356/437 |
| 4,795,253 | A | 1/1989 | Sandridge et al. | 356/51 |
| 4,818,705 | A | 4/1989 | Schneider et al. | 436/164 |
| 4,829,183 | A | 5/1989 | McClatchie et al. | 250/346 |
| 4,868,622 | A | 9/1989 | Shigenaka | 357/30 |
| 4,875,084 | A | 10/1989 | Tohyama | 357/30 |
| 4,914,719 | A | 4/1990 | Conlon et al. | 250/339 |
| 4,924,095 | A | 5/1990 | Swanson, Jr. | 250/338.5 |
| 4,963,023 | A | 10/1990 | Goldovsky et al. | 356/308 |
| 4,999,498 | A | 3/1991 | Hunt et al. | 250/338.5 |
| 5,002,391 | A | 3/1991 | Wolfrum et al. | 356/307 |
| 5,041,723 | A | 8/1991 | Ishida et al. | 250/339 |
| 5,061,854 | A | 10/1991 | Kroutil et al. | 250/339 |
| 5,076,699 | A | 12/1991 | Ryan et al. | 356/437 |
| 5,157,288 | A | 10/1992 | Hill | 307/511 |
| 5,185,648 | A | 2/1993 | Baker et al. | 257/189 |
| 5,210,702 | A | 5/1993 | Bishop et al. | 364/496 |
| 5,239,860 | A | 8/1993 | Harris et al. | 73/61.48 |
| 5,252,828 | A | 10/1993 | Kert et al. | 250/339 |
| 5,255,511 | A | 10/1993 | Maus et al. | 60/274 |
| 5,307,626 | A | 5/1994 | Maus et al. | 60/274 |
| 5,319,199 | A | 6/1994 | Stedman et al. | 250/338.5 |
| 5,332,901 | A | 7/1994 | Eckles et al. | 250/345 |
| 5,343,043 | A | 8/1994 | Johnson | 250/338.5 |
| 5,361,171 | A | 11/1994 | Bleier | 359/855 |
| 5,371,367 | A | 12/1994 | DiDomenico et al. | 250/338.5 |
| 5,373,160 | A | 12/1994 | Taylor | 250/338.5 |
| 5,401,967 | A | 3/1995 | Stedman et al. | 250/338.5 |
| 5,418,366 | A | 5/1995 | Rubin et al. | 250/338.5 |
| 5,489,777 | A | 2/1996 | Stedman et al. | 250/338.5 |
| 5,498,872 | A | 3/1996 | Stedman et al. | 250/338.5 |
| 5,545,897 | A | 8/1996 | Jack | 250/339.13 |
| 5,583,765 | A | 12/1996 | Kleehammer | 364/423.098 |
| 5,591,975 | A | 1/1997 | Jack et al. | 250/338.5 |
| 5,621,166 | A | 4/1997 | Butler | 73/116 |
| 5,644,133 | A | 7/1997 | Didomenico et al. | 250/338.5 |
| 5,719,396 | A | 2/1998 | Jack et al. | 250/338.5 |
| 5,726,450 | A | 3/1998 | Peterson et al. | 250/338.5 |
| 5,797,682 | A | 8/1998 | Kert et al. | 374/123 |
| 5,812,249 | A | 9/1998 | Johnson et al. | 356/28 |
| 5,831,267 | A | 11/1998 | Jack et al. | 250/338.5 |
| 5,922,948 | A | 7/1999 | Lesko et al. | 73/117.3 |
| 6,057,923 | A | 5/2000 | Sachse | 356/364 |
| 6,230,087 | B1 | 5/2001 | Didomenico et al. | 701/29 |
| 6,307,201 | B1 | 10/2001 | Didomenico et al. | 250/339.13 |
| 6,564,377 | B1 * | 5/2003 | Jayasimha et al. | 717/174 |
| 6,701,521 | B1 * | 3/2004 | McLlroy et al. | 717/173 |

OTHER PUBLICATIONS

Bishop, Gary A., Starkey, John R., Ihlenfeldt, Anne, Williams, Walter J. and Stedman Donald H.; "IR Long–Path Photometry: A Remote Sensing Tool for Automobile Emissions"; Analytical Chemistry 1989; vol. 61#10, pp. 671A–677A.

Axelsson, Hakan, Eilard, Anders, Emanuelsson, Annika, Galle, Bo, Edner, Hans, Regnarson Par and Kloo Henrik; "Measurement of Aromatic Hydrocarbons with the DOAS Technique"; Applied Spectroscopy 1995; vol. 49#9., pp. 1254–1260.

Baum, Marc M., Kiyomiya, Eileen S., Kumar Sasi and Lappas, Anastasios M.' "Multicomponent Remote Sensing of Vehicle Exhaust by Dispersive Absorption Spectroscopy. 1. Effect of Fuel Type and Catalyst Performance"; Environmental Science and Technology 2000; pp. 34 & 2851–2858.

Stedman, Donald H. and Smith, Dennis L.; "NOx Data by Remote Sensing"; Coordinating Research Council 1995; pp. 4–47 & 4–63.

Shore, P.R. and Devries, R.S.; "On–line Hydrocarbon Speciation Using FTIR and CI–MS"; Society of Automotive Engineers 1992; SAE #922246.

Bishop, Gary A. and Stedman, Donald H.; "On–Road Carbon Monoxide Emission Measurement Comparisons for the 1988–1989 Colorado Oxy–Fuels Program"; Environmental Science & Technology 1990; pp. 24 & 843–847.

Stedman, Donald H., Bishop, Gary, Peterson, James E., and Geunther, Paul L.; "On–Road CO Remote Sensing in the Los Angeles Basin"; CA–EPA (CARB) 1991; pp. 24 & 843–847.

X–Rite Incorporated; "A Guide to Integrating Sphere Theory and Applications"; 2002; www.labsphere.com.

Geunther, Paul L., Stedman, Donald H., Bishop, Gary A., Beaton, Stuaret P., Bean, James H. and Quine Richard W.; "A Hydrocarbon Detector for the Remote Sensing of Vehicle Exhaust Emissions"; Review of Scientific Instruments 1994; vol. 66(4), pp. 3024–3029.

Stephens, Robert D., Mulawa, Patricia A., Giles, Michael T., Kennedy, Kenneth G., Groblicki, Peter J. and Cadle, Steven H.; "An Experimental Evaluation of Remote Sensing–Based Hydrocarbon Measurements: A Comparison to FID Measurements"; Journal of Air and Waste Management Assoc. 1996; pp. 46 & 148–158.

Stedman, Donald H.; "Automobile Carbon Monoxide Emissions"; Environmental Science and Technology 1989; vol. 23#2, pp. 147–149.

Adachi, Masayuki, Yamagishi, Yutaka, Inoue Kaori and ISHIDA, Kozo; "Automotive Emissions Analyses using FTIR Spectrophotometer"; Society of Automotive Engineers 1992; SAE #920723.

Koplow, Michael D., Jimenez, Jose L., Nelson, David D., Schmidt, Stephan E.; "Characterization of On–Road Vehicle NO Emissions by Means of a TILDAS Remote Sensing Instrument"; Coordinating Research Council 1997; pp. 8–35 & 8–62.

Guenther, Paul Leonard; "Contributions to On–Road Remoter Sensing of Automobile Exhaust"; University of Denver 1992.

Cox, Frank W., Walls, John R. and Carrel, Mark W.; "Determination of Catalyst Oxidation and Reduction Efficiencies from Tailpipe Emissions Measurements"; Society of Automotive Engineers 1997; SAE #972911.

Lawson, Douglas R., Groblicki, Peter J., Stedman, Donald H., Bishop, Gary A. and Guenther Paul L.; "Emissions from In–Use Motor Vehicles in Los Angeles: A Pilot Study of Remote Sensing and the Inspection and Maintenance Program"; Journal of Air and Waste Management Assoc. 1990; vol. 40#8, pp. 1096–1105.

Stedman, Donald H., Bishop, Gary A. and Pitchford, Marc L.; "Evaluation of a Remote Sensor for Mobile Source CO EMISSIONS"; University of Denver 1991; Rpt. #EPA 600/4–90/032.

McLaren, Scott E., Stedman, Donald H., Greenlaw, Pamela D., Bath, Raymond J., and Spear, Richard D.; Comparison of an Open Path UV and FTIR Spectrometer; Air and Waste Management Assoc. 1992; vol. 92–73.10.

Bishop, Gary A., Zhang, Yi, McLaren, Scott E., Guenther, Paul L., Beaton, James E., Stedman, Donald H., Duncan, John W., McArver, Alexander Q., Pierson, William R., Groblicki, Peter J., Knapp, Kenneth T., Zweidinger, Roy B. and Day, Frank J.; Enhancements of Remote Sensing for Vehicle Emissions in Tunnels; Journal of Air and Waste Management 1994; vol. 44, pp. 169–175.

McLaren, Scott E. and Stedman Donald H.; "Flux Measurements Using Simultaneous Long Path Ultraviolet and Infrared Spectroscopy"; Air and Waste Management Assoc. 1990; vol. 90–86.6.

Bishop, Gary A., McLaren, Scott E., Stedman, Donald H., Pierson, William R., Zweidinger, Roy B. and Ray, William D.; "Method Comparisons of Vehicle Emissions Measurements in the Fort McHenry and Tuscarora Mountain Tunnels"; Atmospheric Environment 1996; vol. 30#12, pp. 2307–2316.

McLaren, Scott; "Open Path Spectrometers for Atmospheric Monitoring"; University of Denver 1995.

Stedman, Donald H. and Bishop, Gary A.; "An Analysis of On–Road Remote Sensing as a Tool for Automobile Emissions Control"; Illinois Dept. of Energy & Natural Resources 1990; ILENR/RE–AQ–90/05.

Stedman, Donald H., Peterson, James E. and McVey, IAIN F.; "On–Road Carbon Monoxide and Hydrocarbon Remote Sensing in the Chicago Area"; Illinois Dept. of Energy & Natural Resources 1991; ILENR/RE–AQ–91/14.

Lyons, Carol E. and Stedman, Donald H.; "Remote Sensing Enhanced Motor Vehicle Emissions Control for Pollution Reduction in the Chicago Metropolitan Area: Siting and Issue Analysis"; Illinois Dept. of Energy & Natural Resources 1991; ILENR/RE–AQ–91/15.

Durbin, Thomas D., Truex, Timothy J. and Norbeck, Jospeh M.; "Particulate Measurements and Emissions Characterizations of Alternative Fuel Vehicle Exhaust"; National Renewable Energy Laboratory 1998; NREL/SR–540–25741; Subcont#ACI–7–16637–01.

Didomenico, John, Johnson, Jim, Webster, Jason and Rendahl, Craig S.; "Preliminary Results from Cold Start Sensor Testing"; Coordinating Research Council 1997; pp. 4–71 & 4–72.

Stephens, Robert D. and Cadle, Steven H.; "Remote Sensing Measurements of Carbon Monoxide Emissions from On–Road Vehicles"; Journal of Air and Waste Management Assoc. 1991; vol. 41#1, pp. 39–46.

Jimenez, Jose L., McRae, Gregory J., Nelson, David D., Zahniser, Mark S. and Kolb, Charles E.; "Remote Sensing of NO and $NO_2$ Emissions from Heavy–Duty Diesel Trucks Using Tunable Diode Lasers"; Environmental Science & Technology 2000; pp. 34 & 2380–2387.

Stedman, Donald H., Bishop, Gary A., Guenther, Paul L., Peterson, James E., Beaton, Stuart P. and McVey, Iain F.; "Remote Sensing of On–Road Vehicle Emissions"; University of Denver 1992; Contract #VE–8–1.

Singer, Brett C., Harley, Robert A., Littlejohn, David, Ho, Jerry and Vo, Thu; "Scaling of Infrared Remote Sensor Hydrocarbon Measurements for Motor Vehicle Emission Inventory Calculations"; Environmental Science and Technology 1998; vol. 32#21, pp. 3241–3428.

Atkinson, Chris M., McKain, David L., Gautam, Mridul, El–Gazzar, Laila, Lyons, Donald W. and Clark, Nigel N.; "Speciation of Heavy Duty Diesel Engine Exhaust Emissions"; Coordinating Research Council 1995; pp. 5–71 & 5–92.

Chaney, Lucian W.; "The Remote Measurement of Traffic Generated Carbon Monoxide"; Journal of Air Pollution Control Assoc. 1983; vol. 33#3, pp. 220–222.

Todd, Michael and Barth, Michael; "The Variation of Remote Sensing Emission Measurements with Respect to Vehicle Speed and Acceleration"; Coordinating Research Council 1995; pp. 4–1 & 4–14.

Hoshizaki, H., Wood, A.D and Kemp, D.D.; "Vehicle Inspection Instrumentation"; Lockheed Missiles & Space Company 1973. ARB–3C–235–7.

Sigsby, Jr., John E., Tejada, Silvestre and Ray, William; "Volatile Organic Compound Emissions from 46 In–Use Passenger Cars"; Environmental Science & Technology 1987; pp. 21 & 466–475.

* cited by examiner

SOFTWARE ARCHITECTURE OF AN INTEGRATED HOST SYSTEM FOR SENSED VEHICLE DATA

PRIORITY

The present application is a continuation-in-part of U.S. patent application Ser. No. 09/931,774, filed Aug. 20, 2001, now abandoned entitled Host System for Sensed Vehicle Data, the disclosure of which is incorporated herein by reference in its entirety.

FIELD OF THE INVENTION

The present invention relates generally to systems and methods for processing information that is detected related to vehicles. More particularly, the present invention relates to systems and methods for handling data that is detected relative to vehicles, including, for example, sensed vehicle emission data, sensed vehicle speed data, and captured video information related to vehicles.

BACKGROUND OF THE INVENTION

It is known in the art of vehicle emissions and traffic handling devices to have a system mounted along a vehicle path, such as a lane of a roadway, that can detect various characteristics of passing vehicles. For example, such a system may include a vehicle emissions sensing device that includes a projector/receiver element that projects a light beam across the vehicle path, has it reflected back by a mirror on the other side of the vehicle path, and receives the reflected beam and processes the reflected beam to determine information regarding the emissions from the vehicle.

It is also known to have a vehicle speed and acceleration detecting system on the side of the roadway. Further, it is known to have a video camera placed on the side of the roadway capable of capturing video images of the vehicles, for example, to determine the license plate of the vehicle.

In the exemplary known arrangement described above, each of the three systems: (1) emissions; (2) speed and acceleration; and (3) camera, have been known to be each connected by a respective cable to various processing units that are located in a van positioned on the side of the road near the systems. It is known for the van to have a variety of data processing and data collection devices so that it receives data from each of the three systems and processes it in various manners. The van generally has a method for recording data while at a data gathering site, and is then driven to a central data processing facility in order for the data to be more fully processed at the central data processing facility.

Thus, in the known exemplary system described above, the van operator generally drives to an emissions testing site with all of the equipment including the three detection systems loaded in the van, then unloads these systems and must align them as necessary. The operator then remains with the van while the systems are operating and controls the systems and monitors the data collection while in the van. At the end of a prescribed time (i.e., a sensing session) the operator then disassembles the various sensing equipments from the roadway, loads them into the van, and drives to the central processing facility.

The known arrangement utilizing the van as described above has several disadvantages. One disadvantage is that the external vehicle (i.e., the van) takes up a significant amount of space on the side of the road. Additionally, this vehicle also can interfere with the normal flow of traffic, as motorists might slow down as they approach the van in order to see what activities are taking place on the side of the road. This has the unfortunate consequence of precluding proper testing of vehicles as they are normally driven. Further, the systems generally require an attendant at all times. Also, the cables used to connect the various devices to the van create clutter, are inconvenient, and susceptible to damage.

Moreover, the security of the systems would be desirable if made stronger. The software run in the equipment to make the equipment operate as desired needs to follow contemporary philosophies that blend well with software authoring tools in vogue. Additionally, the software architecture needs to be more flexible in its maintenance as newer versions of code are produced throughout the life cycle of the testing equipment, and be applicable to work across an entire network of information regarding sensed vehicles.

Accordingly, it is desirable to provide a system that reduces the size and mass of apparatus required for sensing and capturing vehicle data along the vehicle path such as a roadway. It is also desirable to have a convenient and secure device and method for processing sensed vehicle data and transmitting it to a central processing facility.

SUMMARY OF THE INVENTION

It is therefore a feature and advantage of the present invention to provide a system that reduces the size and mass of apparatus required for sensing and capturing vehicle data along the vehicle path such as a roadway.

It is another feature and advantage of the present invention to provide a convenient and secure device and method for processing sensed vehicle data and transmitting it to a central processing facility.

It is another feature and advantage to have a software architecture within such a system that utilizes contemporary software programming techniques and objects, while preserving the immediacy of data collection in the real time for vehicles that are tested in less than one second. Such architecture has component pieces arranged in an n-tier architecture, which facilitates reduced maintenance of the software components throughout the life cycle of the embodiment.

The above and other features and advantages are achieved through the use of a novel host system and method for sensed vehicle data as herein disclosed. In accordance with one embodiment of the present invention, a system for processing sensed vehicle data includes a sensor for sensing data related to at least one characteristic of a passing vehicle and a host unit that receives sensed data from the sensor. The sensor and the host unit are integrated into a single housing. The host stores data and communicates with peripheral devices and/or with a central processing facility.

In accordance with another embodiment of the present invention, a method is provided for processing sensed vehicle data, comprising the steps of: sensing data related to at least one characteristic of a passing vehicle, receiving and storing the sensed data with a host unit that is integrated into a single housing together the sensor, and communicating between the host and a peripheral device. The peripheral device comprises at least one of a laptop computer, a Personal Digital Assistant, and a desktop computer.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

The preferred embodiments of the present invention provides a system that reduces the size and mass of apparatus required for sensing and capturing vehicle data along the vehicle path such as a roadway. Also provided in preferred embodiments are a convenient and secure device and method for processing sensed vehicle data and transmitting it to a central processing facility.

Figure 1:
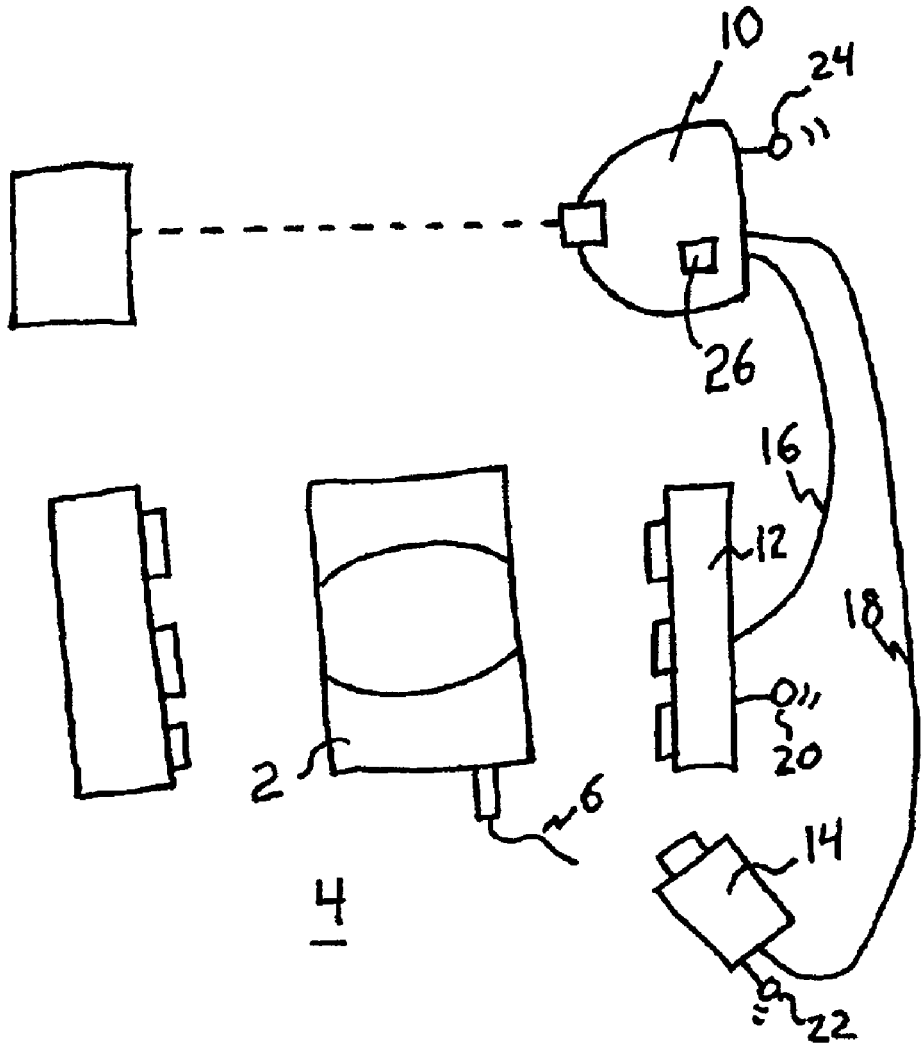
FIG. 1 is a schematic plan view illustrating several elements of a preferred embodiment of the present invention.

A preferred embodiment of the present inventive apparatus and method is illustrated in FIG. 1, which illustrates a vehicle 2 travelling along a path 4 and producing an emissions plume 6. An integral host device 10 includes apparatus for projecting a beam across the vehicle path and receiving the reflected beam from a reflector across the path. When a vehicle has crossed the beam path, emissions from the tailpipe 6 can be detected by appropriate optical systems and electronic circuitry within the host unit 10.

Also provided with the system may be a speed and acceleration sensing system 12 and a video or other type of camera 14. The speed and acceleration sensor 12 may detect data regarding the speed and/or acceleration of the vehicle as it passes, and the camera 14 may provide a picture of the vehicle including its license plate.

In one embodiment, the speed and acceleration system 12 and camera 14 may communicate with the host 10 via wires 16 and 18 respectively. Alternatively, either or both of these units may communicate wirelessly via an antenna 20 on the speed and acceleration system 12, and an antenna 22 on the camera 14, with an antenna 24 provided on the host unit 10. Thus, either or both of the devices 12 and 14 may communicate by either a corded or wireless fashion with the host unit 10.

The host unit 10 receives data regarding each passing vehicle, which may include in the preferred embodiment speed and acceleration data, video or other picture data of the vehicle, and data regarding the tailpipe emissions from the vehicle. Any of these three detection systems may be incorporated in as the host unit 10. In the illustrated embodiment, the emissions sensor is incorporated with the host unit 10 in a common housing. In alternative embodiments, a system may be configured that only senses the speed of the vehicle and records a picture of the vehicle, without sensing emissions. In such embodiments, the host unit 10 can be a separate unit or can be incorporated with the unit that senses speed and acceleration. In other embodiments, the host unit 10 might sense other vehicle data. Thus, although the host unit 10 is illustrated in FIG. 1 as containing the emissions detection unit as well, the host unit 10 could alternatively be incorporated with the speed and acceleration system 12, or the camera unit 14.

In a preferred embodiment, the host unit 10 receives the data into a central processing unit 26, which may be an EBX platform computer, using a PC104 or PC104+ bus structure. This arrangement provides a desirable degree of compactness. However, any suitable CPU unit may be used.

In a preferred embodiment, the host system 10 records a log of individual vehicle entries including sensed data. The log may also include user input information and other information about the circumstances surrounding each captured entry. The user can append the log with such information via any of the external peripherals 30, 32, and 36 described below as part of a discussion on FIG. 2. The host 10 can then record this user input information in a log that may also include specific vehicle entries. In addition, the log can contain date and time of recurrent events and activities conducted by the host, and contain exception and problem events. Lastly, the log can contain date and time of when a user logged into and out of the host. All of this information is useful in the validation of the data collected by the host.

Figure 2:
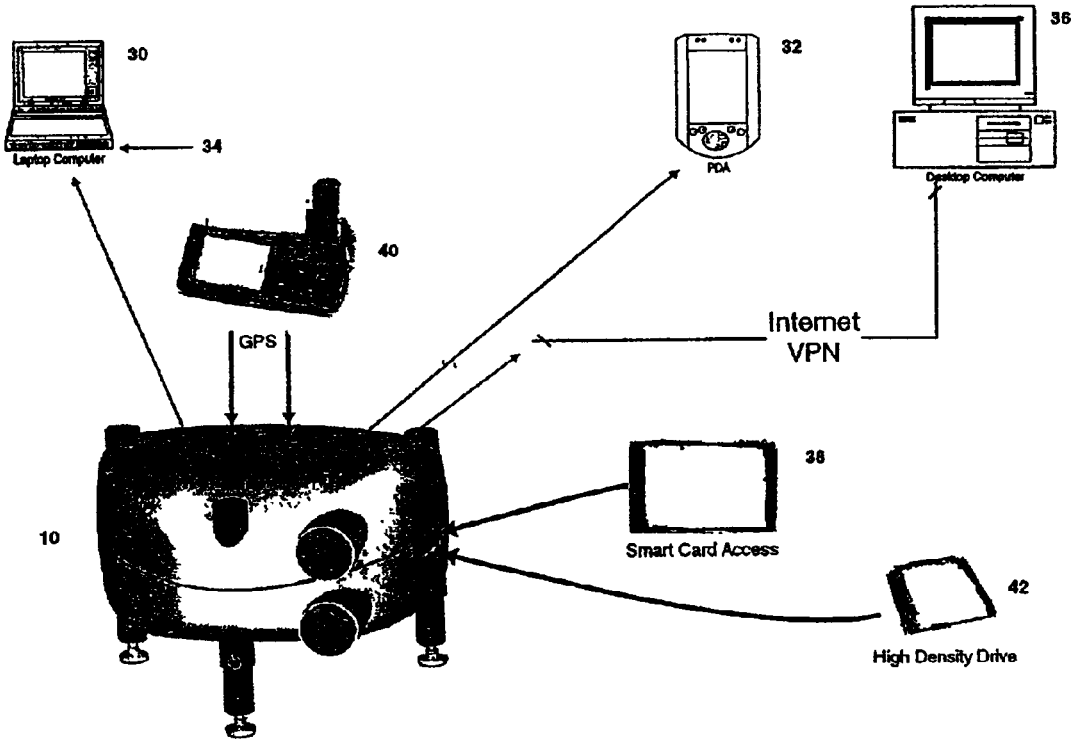
FIG. 2 is a schematic view depicting a host and various data input and output devices, and other devices which may be utilized in preferred embodiments of the invention.
Figure 3:
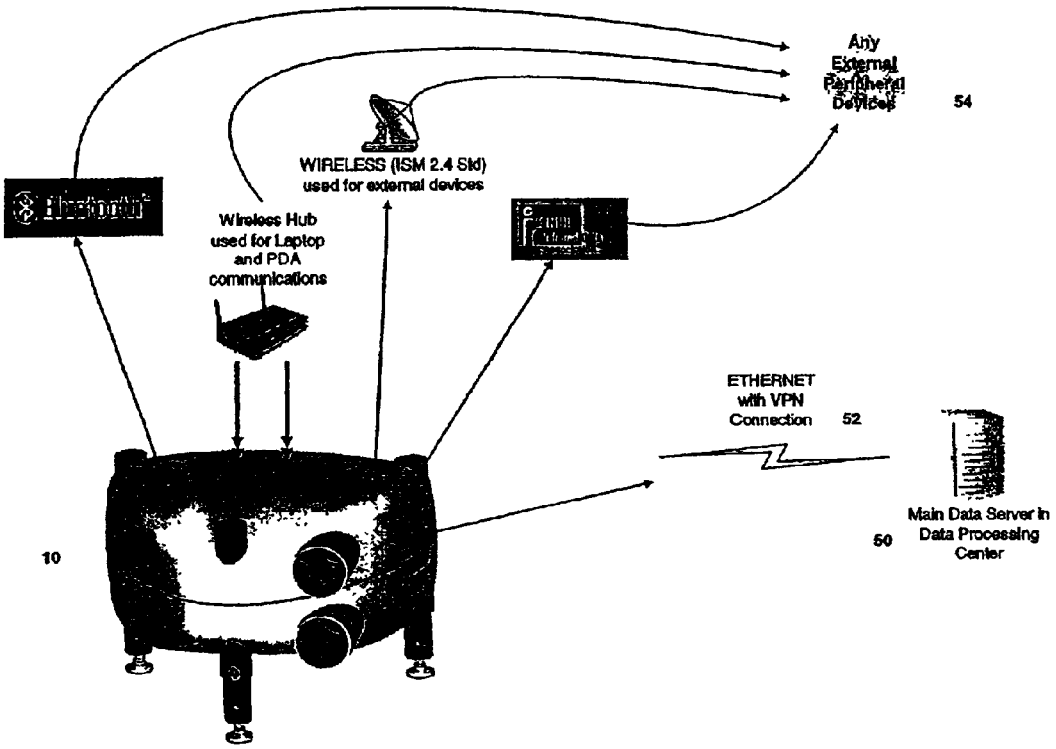
FIG. 3 is a schematic view depicting several modes of communication that may be utilized between a host and various other devices in preferred embodiments of the invention.

FIG. 2 is a schematic view depicting a host and various data input and output devices, and other devices which may be utilized in preferred embodiments of the invention. FIG. 3 is a schematic view depicting several modes of communication that may be utilized between a host and various other devices in preferred embodiments of the invention.

Before going into detail of FIGS. 2 and 3, it is fruitful to review the Open Systems Interconnection (OSI) reference model for the networking of dissimilar hardware and software platforms. The OSI model has been in existence since 1984, being produced by the International Standards Organization (ISO). There are seven layers to the OSI model as listed in Table 1. Several portions of this embodiment cover different layers of the OSI model and will be pointed out in the following text for the sake of clarity, to distinguish at times from hardware and software innovations of this embodiment. In general all but the first layer are software in nature.

TABLE 1

| OSI Model | |
|---|---|
| Level | |
| | Upper Layers |
| 7 | Application |
| 6 | Presentation |
| 5 | Session |
| | Lower Layers |
| 4 | Transport |
| 3 | Network |
| 2 | Data Link |
| 1 | Physical |

As described in ore detail herein, and as shown in FIG. 2, a wide variety of methods can be used (1) to input sensed data to the central processing unit (FIG. 1: 26) (2) to input instructions to the central processing unit 26, and (3) to retrieve vehicle-related and other data that has been stored by the central processing unit 26. Any or all of these three functions can be achieved by using any or all of the various peripheral communication equipment described. For example, as illustrated in FIG. 2, it is possible for an operator to visit the site and utilize a laptop computer 30 and/or a Personal Digital Assistant ("PDA") 32 to perform these functions on the unattended host 10. Typically, an operator may use a PDA 32 or a laptop computer 30 to input instructions to the host 10 to perform a given function. A list of some functions to be implemented by this embodiment is listed in Table 2. The laptop computer 30 and/or PDA 32 can also be used to display various information about the host 10, such as present operational settings (System Information), vehicle emissions test information in real-time, and other functions. This provides an advantage of the invention, whereby there is no need to provide a display or input keyboard on the host unit 10 itself. These devices can be linked into the host 10 either through an Ethernet connection, or through the preferred means of a wireless connection. A wireless connection provides greater flexibility for the operator in checking the operational status of the system.

TABLE 2

| List of Major and Minor Functions of Host | |
|---|---|
| Major Functions | Minor Functions off from Major |
| Power Up | |
| Setup | |
| | Log in |
| | Program System Information |
| | Optical Path Alignment |
| | Camera Alignment |
| | Calibration |
| | Revise Permanent Setup Information |
| Monitor | |
| | Vehicle Emissions Test |
| | Test Review |
| | System Information |
| Upload Data | |
| Log Off | |
| Shut Down | |

If the memory of the laptop 30 or PDA 32 is adequate, the vehicle data records obtained from a sensing session may be transferred into the laptop 30 and/or PDA 32 and then physically carried to a central processing station where the data is downloaded and processed.

In one preferred embodiment, the data can be downloaded onto a high density storage drive system 34 associated with the laptop computer 30. Alternatively, a high density drive system 42 could be incorporated in the host unit 10, with a removable memory element that is connected to the host 10 via an Integrated Drive Electronics (IDE), Small Computer System Interface (SCSI), PC Card Type II adapter or Universal Serial Bus (USB) connection, then removed by the user to be taken to a central processing facility. In a preferred embodiment, the drive 42 is a compactflash (CF+) Type II hard drive (e.g., IBM Microdrive TM).

However, if host unit 10 is to be used in an environment not conducive to removable media, the preferred embodiment is to omit the installation of a drive bay and connections for removable media within said host 10, and rely on the wireless transfer of data to an external device such as laptop 30 or PDA 32. The laptop 30 or PDA 32 can then have the removable media capability in order to transport large volumes of data that the host system 10 is capable of collecting. A ruggadized USB connection is also desired in these harsh environment service areas where significant amount of road dust, precipitation, and other elements preclude the utilization of open and exposed computer-type contact surfaces.

In addition to, or as an alternative to, the use of a laptop 30 or a PDA 32, the host 10 on the laptop 30 or PDA 32 may be connected through the Internet via a Virtual Private Network ("VPN") to a desktop computer 36 using a client/server relationship. A VPN is an example of a special implementation in this embodiment of the fifth layer of the OSI Model (Table 1), and provides for an added measure of security to the data, very important for utilizations of this embodiment that are used for enforcement of traffic and/or emissions laws. The desktop computer 36 can perform the same functions as the laptop 30 or PDA 32, and in fact potentially run the same applications as the laptop 30 if desired. The desktop computer 36 may be located in a remote central data processing facility, or may be located at an intermediate location or even at the sensing site, or near the host 10.

In a preferred embodiment, "smart card" technology is used to enhance the security of the system. The host unit 10 may include a slot for reading a smart card 38. Each of the other peripherals such as the laptop computer 30, PDA 32 and/or the desktop computer 36 may also each have a smart card reader.

The security levels by using different smart cards can be segregated by "per user" and "per function" type of security. Smart cards can be programmed with levels of security for different types of users such as for example, Auditor, Field Technician, Repair Technician, Engineer, and other types of users and security levels commensurate with such users. Users can be permitted to or prevented from accessing certain features and functions of the host unit 10 and associated commands and stored data. The same is true for devices that may attempt a function that the device cannot support or should be prevented from even initiating a function. Given the programmable flexibility of a smart card, per user validation can be set to expire, master site list can be periodically updated, and simple applets can be added, updated, and removed per individual network requirements.

An additional feature of the preferred embodiment is that the host unit 10 can communicate with, or incorporate a global positioning system ("GPS") receiver unit 40. One benefit of communicating with a GPS unit 40 is that the host unit 10 can record its location from many satellites orbiting the earth so that data records taken at that location will include a precise identification of the location. In addition, the GPS unit 40 provides date and time information via the GPS system. Accordingly, when a user first sets up the host 10 at a location, the user can use the GPS unit 40 to provide location, date, and time information. The GPS unit 40 may be a separate handheld device carried by the user, or in a preferred embodiment, be provided by appropriate circuitry permanently installed into the host unit 10. The smart card may also hold a master list of locations with coordinates for the locations of where the host may be located, in order to compare GPS unit 40 data against expected coordinates-providing an added measure of quality control.

Further, in some embodiments the host 10 also has the ability to verify information (for example, where the host 10 has an internal GPS unit 40 that provides current date and time). In those embodiments the host 10 can validate the date and time of peripherals such as laptop 30, PDA, 32, and desktop 36 when connected to ensure accuracy. That is, the host will synchronize, or reset, the internal time of a peripheral with date and time information provided by GPS unit 40 in the host 10.

FIG. 3 illustrates various modes of communication by which the host 10 may communicate with the various peripheral devices of FIG. 2, and ultimately with a central data server unit 50 in a central processing facility. One way for such communication is for the host unit 10 to be connected directly, either by wire, wireless, or combination of wire and wireless connection, with the central data server unit 50 via a VPN 52 over the Internet. This can be facilitated if the host 10 is permanently or semi-permanently mounted on the side of a road where testing of vehicles is desired. The central data server unit 50 will have running on it a Structured Query Language (SQL) application, such as an Active Data Object (ADO), to allow for acquisition of data from the remote host 10, as both the host 10 and the central data server unit 50 will have SQL type databases as opposed to a flat file structure. SQL databases allow for a much greater level of security with the data not only from unauthorized use of the data, but also restrict access to certain data records and fields to avoid unintended modifications to such fields.

Data residing on the host 10 as a result of one or more sensing sessions will initially get replicated to the central data server unit 50 if a direct connection over a VPN 52 exists. If not a direct connection between host 10 and central data server unit 50, then replication of the data occurs through intermediate means such as suggested between the laptop 32 and the host 10, and then from the laptop 32 to the central data server unit 50. Replication is a concept where data residing on the host is not immediately deleted when uploaded to the external peripheral 54 or server 50. For example, using the SQL command "Select" through an ADO object to glean data from the host 10 for all data rows (records) that are within a range of specified date and time allows a nondestructive query of the host 10 data, yet allows for the transfer of the data obtained from the query. Raw data residing on the host 10 is not deleted until final editing activities have been completed in the central data processing facility. These data editing activities can include completing any records that are incomplete, validation of the raw data, and archival of the data. This procedure of replication, retaining original (raw) data in the host 10 and copying the host 10 data to an external system 50 for processing on the external system 50, serves to significantly reduce the possibility of loss of data due to corrupted data transmissions, corruption during the centralized data processing activities, or other calamity affecting the centralized data processing facility. It is not felt important to replicate data to more than just the central server 50 if employing the intermediate step of using a laptop or other peripheral to transport data between the host 10 and the central server 50. Procedurally, it is in the preferred embodiment to have the host 10 always retain raw data until instructed to delete data (i.e. replication activities occur between the host 10 and central server 50, with intermediate systems not required to hold transition data).

In addition, the host unit can send information and receive information using any of the "Blue Tooth" standard, jump-scanned wireless RF frequencies, and/or infrared ("IRDA") communications. Each of these networking technologies is consistent with the lower layers of the OSI Model as seen in Table 1, and is of no concern to the upper layers of the model, part of the beauty of the model. A given physical layer technology has greater or lesser advantage depending upon the distance the wireless signal has to travel, the number of wireless connections that exist between the host 10 and devices (FIG. 1: 12, 14) and/or peripherals (FIG. 2: 30, 32, 36), collectively shown in FIG. 3 as item 54, and whether there is a great need for secure transmissions of data. For the sake of economy, a simple jump scanning RF technology is preferred. If distances are close between the host 10 and devices and peripherals 54, an IRDA wireless method is suitable. For secure transactions among many devices and peripherals 54, the preferred embodiment would be to utilize Blue Tooth technology. These networking hardware technologies can be mixed and matched within the embodiment of this invention if desired to meet combinations of need.

Management of wired or wireless connections between the host 10, external devices and peripherals 54, and central data server unit 50 is preferred to be handled through an in-vogue protocol such as Windows Sockets (Winsock™) utilizing TCP/IP, primarily for the universal nature of Winsock (fourth and fifth layers of the OSI Model as listed in Table 1) being available in more than one programming language, and working across more than one operating system. However, other networking programming interfaces may be employed, particularly if a programming environment other than Microsoft Visual Studio is chosen, and/or utilizing other networking protocols besides TCP/IP. For instance, the host 10 can have Visual C++ applications running on a Windows CE™ platform, the laptop 30 can have Visual BASIC applications running on Windows 2000™, the central data server unit 50 can have Java applications/applets running on Windows 2000 Server™ which has a SQL server application in the form of an ADO module or other means also running, and yet the host 10 can interact with all systems seamlessly through Winsock.

This adds flexibility to the total data collection environment as illustrated in FIG. 3, by utilizing and adapting industry standard communications methods, protocols, and hardware implementations, along with allowing for multiple operating systems for each peripheral; the rudiments of the OSI Model as applied to creating this embodiment. Flexibility of the embodiment is also enhanced through the use of a common networking programming interface by allowing applications (layer seven of OSI Model) written for the host 10, laptop 30, PDA 32, desktop computer 36, and the central server 50 to all be potentially written in different computer languages running on different platforms as exampled above, such that the best attributes of a given language and operating system combination can be employed for the given hardware platform and operating system. The "best" combinations for host 10, each peripheral 54, and central server 50 are dictated by the economics of computing hardware, networking hardware and drivers, availability of software engineers with various language skills, and costs to provide support and maintenance of the entire data system.

Figure 4:
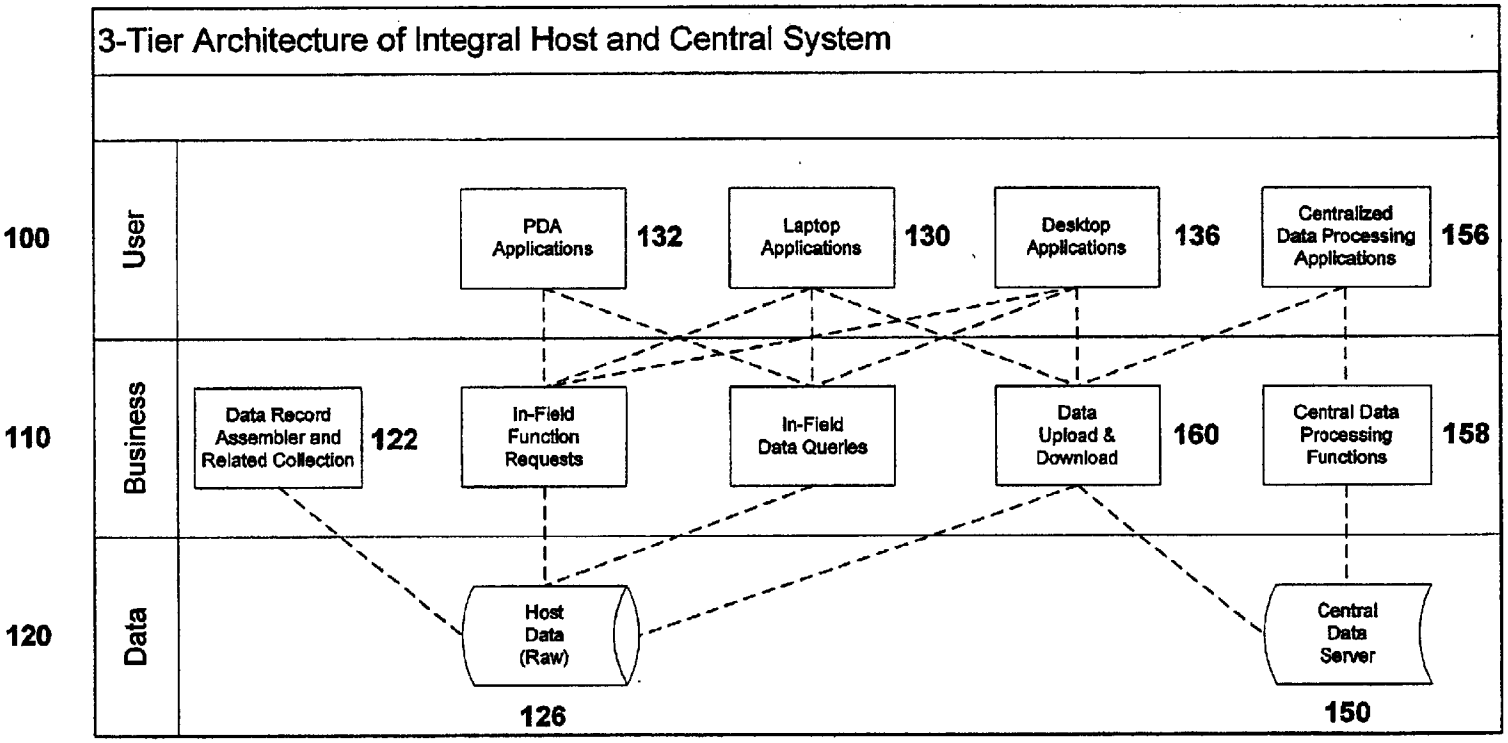
FIG. 4 is a schematic view of n-tier architecture technique as applied to the preferred embodiment.

The architecture of FIG. 4 is known as a 3-tier architecture to those skilled in the art of contemporary software design. Each tier has elements that exist independently of elements within the tier and independently from elements in other tiers, and is a logical layout of how software components relate to each other, per lines connecting boxes within the architecture. The architecture as illustrated in FIG. 4 is meant to be a logical map and not a complete rendering of all specific routines within the hardware components that comprise the data system of this embodiment. Nonetheless, there is sufficient detail for those skilled in the art to see the application of 3-tier design into the preferred embodiment.

An upper layer such as User tier 100 is where all of the user interface applications exist. In this embodiment, the applications written in this tier are preferably written in Visual BASIC, which offers a broad amount of controls and services useful to present data to the user, provide controls for the user to easily learn the means of operating the host (FIG. 1: 10), and affords simple and organized maintenance of the applications for future enhancement. However, this language choice should not be limiting, as Java or other programming languages can yield applications and scripts in an HTML document that easily fulfill desired tasks of the user interface to the system, and therefore can be one such alternative embodiment. Part of the criteria for selecting a computer language for User tier applications 132, 130, 136, 156 is the availability of software engineers who can perform the coding efforts. Ideally, laptop 130 and desktop 136 applications are the same, in the interest of reducing the software maintenance burden. However, PDA 132 applications are unique and limited to the portability of computer instruction code to the processor-type in the PDA (FIG. 2: 32). Additionally, the PDA 32 does not have the memory storage capabilities that a traditional laptop (FIG. 2: 30) or desktop (FIG. 2: 36) machines have. For these reasons, PDA 132 applications are unique to the PDA 32.

A middle layer such as Business tier 110 has applications that implement the needs of the business usage, that is collection of information about passing vehicles (FIG. 1: 4), of the preferred embodiment. These applications can be whole routines or applets that implement a specific business function. For example, there are routines embodied in the host (FIG. 1: 10) that have no interface with users and do nothing but implement the collection of the data from a passing vehicle, denoted as Data Record Assembler and Related Collection of FIG. 4 item 122. Other similar routines may physically reside within the host 10 and central data server unit (FIG. 3: 50) provide specific functions that append vehicle and related data to the databases of the host 126, but which do not have interaction with the "outside world". These other routines within the Business tier 110 implement data collection or data queries that are initiated by the user of the system or initiated by automated tasks queued into the system. The Business tier 110 is the only means by which data can be acquired from the databases shown in the Data tier 120. This provides for a consistency should there be a need, after initial creation of the system, to revise a user application 132, 130, 136, 156, or a database 126, 150. A revised user application 132, 130, 136, 156 can replace prior versions of these applications without any impact to the Business tier 110 applications or Data tier 120 databases, one of the main features of applying 3-tier software architecture design to this embodiment.

A lower layer such as Data tier 120 essentially contains databases that are used by the system to permanently hold information of interest. While, for illustration purposes, only two databases are indicated in FIG. 4 at the Data tier 120, there can be nonetheless many databases contained within the physical hardware of the host 10 and central data server unit 50. Information collected from a passing vehicle (FIG. 1: 2), information about where the host 10 was set up for the data collection and a description of the path 4 that the vehicle took when sampled, conditions under which the vehicle 2 was sampled, quality assurance information, host 10 setup parameters, and other useful, pertinent data can be stored in databases of items 126 and 150 within the Data tier 120.

Data initially collected in the field by the host 10 is considered "raw" data, meaning it is unedited. Some pre-editing of the data can occur within the host 10, however it is not good practice to make changes to a raw database without somehow retaining the raw data in the event that the raw data needs to be restored. For this reason, the raw data is eventually and periodically replicated over to the central data server 150 database. It is in the central data server 150 database where all data editing is recommended. Data editing can be both a manual procedure, accomplished through one or more data processing applications 156, or through an automated means by running one or more preprogrammed automated task in the form of a Business tier 110 central data processing function 158. An example of a manual data editing task would be entering license plate information about the passing vehicle 2, except that in the preferred embodiment, the method of editing is performed using components designed for a multi-tiered software architecture. An example of an automated data editing task would be to scan through many vehicle records of the central data server 156 database, looking for records that do not meet quality assurance objectives and are therefore appropriately flagged in some means. The quality assurance objectives can be preprogrammed into a Business tier 110 application 158 that is queued in the operating system of the centralized data server unit 50 once new raw data has arrived into the server database 150.

Should there be some sort of data disaster prior to completion of editing tasks, the original raw data can be reacquired from the host data 126, by some direct means of query through a Business tier application 160. This is assuming that there is a direct VPN connection (FIG. 3: 52) between the host 10 and the central data server unit 50, or if not, by alerting a user to reacquire data through the path of a Business tier application 158 to a User tier application 156. A user would then acquire the data from the host database 126 via one of several possible user interface means 132, 130, 136 to the host database 126, through a business tier application designed for uploads and downloads of data 160.

While this indirect path of operation may seem cumbersome, the fact is that software maintenance is greatly reduced by implementation of a multi-tiered software architecture. This is primarily true because applications can be modified in any of the tiers and within tiers, without the modifications affecting other applications or databases found within the system. For instance, it is of no consequence to the field user, and therefore user applications 132, 130, 136 with which the user interacts, if it is determined that a new quality assurance field is added to the central server database 156. In this instance, the only changes needed in the system are to the database 150 to provide for storage of the new variable, modification to a Business tier application 158 to access the new variable, and possibly to a centralized data processing application 156 that updates or views the new variable. No other portions of the system are affected.

Figure 5:
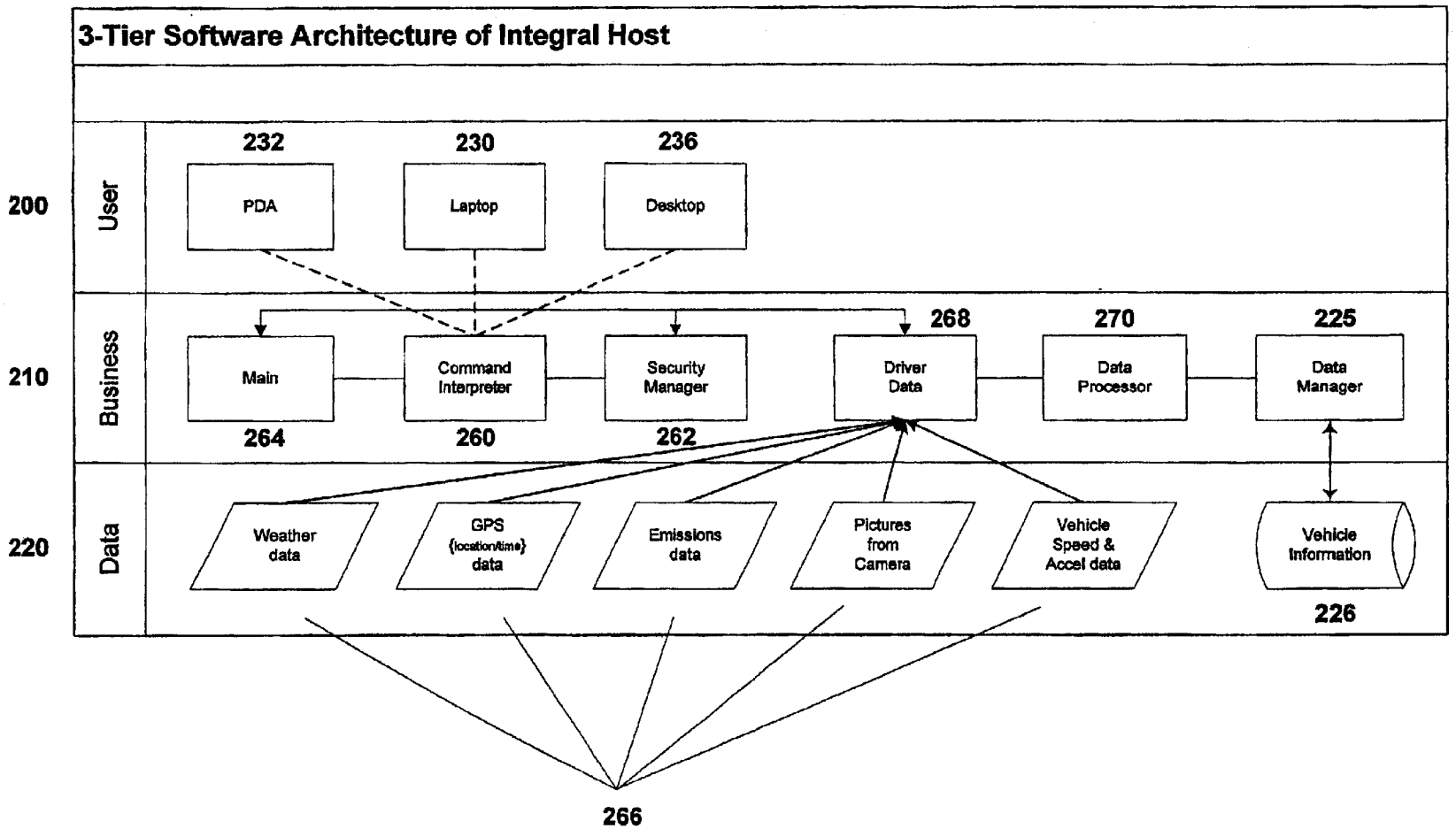
FIG. 5 is a flow chart of major components of the system software architecture.

A specific software architecture of the host (FIG. 1: 10) is shown in FIG. 5. Several innovations have been applied to the host in order to integrate the functions of data collection with data interpretation and data storage all into one compact unit. Current art in the open-path on-road emissions testing field has only a data collection means out at the side of a road, perpendicular to the path (FIG. 1: 4) of vehicular traffic, and in the place of this embodiment's integral host 10. This data collection means is tethered to a separate host computer located in a host vehicle also on the side of the road that gathers the various data about a passing vehicle (FIG. 1: 2) of which one of the data elements is the measurement of emissions emanating from the vehicle's exhaust (FIG. 1: 6), another element is the speed and acceleration measurement through some means of measuring speed and acceleration (FIG. 1: 12) of the vehicle 2, and still another element is a video image of the vehicle 2 through some camera means (FIG. 1: 14). Global position of the host 10 and correct date & time, both of which collected from a GPS unit (FIG. 2: 40), and weather data to record ambient conditions are not routinely gathered by current art systems. These additional parameters contribute to improved quality assurance of the emissions data collected, as corrections to the emissions measurement back to standard temperature and pressure can be made. Variability of time keeping by a host system 10 can cause the entire dataset not to be trusted, particularly if the time drift is significant. A preferred embodiment however includes collection of this additional data, through an integrated means within the data collection means, which has been referred to as "host" throughout this description.

One major challenge in integrating the data collection with data interpretation and data storage into one computing system utilizing one microprocessor is that vehicles travel the testing path 4 at speeds from 20–100 kilometers per hour, thereby not allowing much time for the emissions test to take place. This emissions testing must occur in real-time, not being put off as a task in a queue to the processor of a data collection device for eventual execution. Couple this with the fact that an image of the vehicle needs to be captured prior to the vehicle 2 disappearing out of view are reasons that contribute to the current state of the art having a dedicated processor unit collect emissions data out at the roadway and send the data by wired cable means to a separate host computer that can assemble all the emissions, speed and acceleration, and video image data. The separate host computer, usually located in a host vehicle such as a van, does not have such an intensive real-time data collection requirement, as a data record can be assembled at anytime after the data event of a vehicle passing, though not without some risks of sequence misalignment of data elements from various sources of data. Furthermore, current computer operating systems from Microsoft do not normally allow for real-time data access, yet it is desired to use Microsoft products as part of systems integration due to the large numbers of software engineers who can work with Microsoft products, in comparison to those skilled with products of other vendors.

However, one preferred embodiment of this invention is to nonetheless integrate all of the functions of data collection, interpretation, and storage into one host unit that also contains the emissions testing means, obviating any separate host computer and supporting hardware and vehicle to gather data from all sources, interpret same, and store for later retrieval, while using Microsoft operating systems and Visual Studio developed products. The usage of Microsoft products provides a large labor pool of software engineers already skilled in coding and porting applications that are running on a Microsoft operating system platform. Furthermore, the ubiquitous availability of Microsoft operating systems and language products provides for an economy when purchasing supporting products used to produce the embodiment. Many commercially available items of computing hardware already have Microsoft operating system drivers that link the hardware to the software, thus saving valuable coding efforts for integrating systems to work together and not having to additionally expend resources developing driver code.

This is not to be concluded that a preferred embodiment must be coded to run on a Microsoft platform. Linux and other operating systems have desirable characteristics that lend themselves well to fulfilling the tasks of an integrated host system, including multitasking, multithreaded, preemptive abilities to run real-time applications and routines of higher priority over lesser priority tasks, SQL-compatible databases, simpler driver development (though drivers will most likely require development for these other systems), and coding in languages such as C, Java, and other contemporary languages, providing something of a labor pool of software engineers who could adapt to the differences between Microsoft products and others. However, for the purposes of simplicity of discussion, this description will use terms normally reserved for Microsoft products when reviewing the elements of FIG. 5. Persons skilled in the art of software development can appreciate that there are features of other operating systems and programming environments that are analogous to the terms used in this description.

Each of the boxes represented within the Business tier 210 can be Component Object Model (COM) objects that are instantiated by the main program of the host, or can be threads of varying priority created by the main program. COM objects lend very well to a multi-tiered software architecture, in that they are essentially external routines to an application, and as such, can be compiled independently with new features if desired, without the application itself requiring recompilation. This is a distinct advantage over any existing art that has all features and functions of a system compiled into perhaps only one application or project for each device in the system. Future software maintenance of the preferred embodiment host system is simplified, as there is no need to create and maintain a legacy archive of all previous versions of applications and code that comprises those applications. By nature of a COM object as defined by Microsoft, a software engineer who creates or inherits the code of a COM object must maintain the interface of the COM object throughout all iterations of code revisions to the COM object, in order for legacy and subsequently new applications to be able to use newer versions of the COM object. While the interface to the COM object is the same, the inner workings of the COM object can be revised, even radically, without the application ever "realizing" that a change has been made. Furthermore, new properties and functions can be added to a COM object without any changes made to the interface.

A special variant of COM, known as DCOM for Distributed Component Object Model, allows COM objects to be located in a physical machine outside of the machine that is running a given application. For instance, the host 10 can have a DCOM object within its memory that is available to, and possibly even be required for proper function execution by, an external peripheral such as the laptop (FIG. 2: 30) or other peripheral, provided that applications on the peripheral have the requisite software and configuration to run a DCOM object. This feature, similar to that of a resident COM object, allows for simplified and reduced software maintenance requirements of a system, as legacy applications can run newer versions of DCOM objects that may reside in a machine that is more convenient for updating by network administrators. There is also an added measure of security with DCOM objects utilization, as it is harder for a feature to be used to "hack" into a host, if the offending external peripheral does not have the capability to run, or does not know the existence or need for the ability to run a DCOM object in order to properly interface with the host 10 (security through obscurity).

As stated above, FIG. 5 illustrates a preferred 3-tier software architecture for integrating the functions of data collection, interpretation, and storage all into one host unit (FIG. 1: 10) that also at a minimum collects emissions information from vehicles that pass the host. To allow for said integrated host 10 to operate unattended and without requiring any separate supporting computer and vehicle, the user interface is through either a wired means such as through a serial port or USB connection, or through the preferred means of a wireless connection. Applications that run on external peripherals that can interface with the integrated host 10 include a laptop, also known as notebook computer 230, a PDA 232, and desktop computer applications 236. None of these applications have a direct impact on the applications of the integral host, and therefore can be revised independently of the software of the host 10 as illustrated in FIG. 4. The preferred link between these applications and the host applications follows the OSI Model as previously discussed, with Winsock utilizing TCP/IP providing the communications means between the peripheral user interface and the host 10, however other suitable links and networking protocols may be implemented.

All user commands from the peripheral come into the host 10 through a command interpreter object 260 running in the Business tier 210 of the 3-tier architecture. This Command Interpreter 260 is preferred to be a COM object, however could easily be a thread of the main program of the host 10. The Command Interpreter 260 will verify a given command against security clearance, done through the Security Manager object 262 to execute that command. A list of suggested commands to be used by the host are listed in Table 3. Assuming security clearance has been granted, the Command Interpreter 260 then processes the command as appropriate, usually by, depending upon the extent of the needs in executing the command, send the command off to a module dedicated to accomplish that task, send command to a Main routine 264 of the host application, or executing the command directly. For example, the received command may be to set the mode of the host into a data collection mode. Data collection mode is defined as collect data from emissions, speed and acceleration, camera, GPS, and weather systems upon the presence of a vehicle (FIG. 1: 2) breaking the sample path which is roughly perpendicular to the path of the vehicle (FIG. 1: 4), interpret the emissions of the vehicle by applying Beer-Lambert Law or other suitable method and applying a combustion equation to correct for dilution of the exhaust emissions (FIG. 1: 6), then logically store the resulting data obtained from all of the sources of data available as mentioned above.

TABLE 3

| Command Set for Integral Host |
|---|
| Command + Argument Format |
| File |
| SQL |
| Table |
| Start |
| Stop |
| Request |
| Error |
| Delete |
| Set Mode |

Physical collection of raw data is represented in the Data tier 220 of FIG. 5 by devices interfaced into the host 10 through COM objects collectively referred to as item 266. Various databases exist in this tier that provide operating parameters of the integral host 10 including but not limited to "permanent" setup parameters of devices contained within the host 10 (if the system registry is not used for this purpose), calibration information, monitoring site information, and other data elements that are routinely referenced by the host system 10 but not normally user accessible or otherwise changeable data. Additionally, there are databases that reserve space for storage of data collected about the vehicles that have passed by the system.

Data collection devices each preferably have a COM object 266 associated with the respective device. A COM object is preferred over utilization of an integrated thread within the main application of the host 10, as future versions of the host 10 may use different device hardware to deliver a data stream of specific information. For example, there are several manufacturers of weather collection data equipment. If a COM object 266 is used as a means for a host application to collect weather data, future versions of the weather COM object 266 could be made to interface with more than one manufacturer's equipment and be loaded into the host memory, without ever having to recompile the Business tier 210 application that periodically requests data from the weather device, in this case denoted as item 268 of FIG. 5. This newer version of the COM object 266 can also allow legacy host systems to be retrofitted with weather data gathering equipment from any of several vendors without any need for updating the version of the application 268 in the host that periodically requests weather data.

In a preferred embodiment, there is one COM object 268 in the Business tier 210 that collects all of the data from COM objects 266 associated with various data gathering devices. This data is then assembled into dynamic arrays of a particular data class and passed off to a Data Processor object 270. The Data Processor object 270 for example takes raw emissions data and calculates emissions measurements based on optical absorption, corrects the measurement to Standard Temperature & Pressure (STP), and runs these emissions measurements through a combustion equation to correct for dilution of exhaust (FIG. 1: 6) from the tested vehicle. Additional processing can take place within this Data Processing object 270 that will take raw measurements from any data source and calculate and/or convert the data into something useable.

Processed data from the Data Processor object 270 is then sent to a Data Manager object 225 that eventually commits the data to permanent storage. Because of the need for the host's processor (FIG. 1: 26) to devote virtual real-time attention to emissions measurements, COM objects 266 the gather time-critical information about a passing vehicle 2 are generally set at a high priority. The data storage object 225 can be set to run at a much lower priority to minimally intrude on processor time, as it is not as time critical to commit data to permanent storage so long as data is eventually committed to such permanent storage 226.

For illustration brevity sake, all databases and tables contained within them are represented in FIG. 5 as item 226. The physical structure of the host databases is such that a Business tier 210 application 225 is associated with a database to be consistent with the structure of a 3-tiered software architecture. Normalization of the tables of databases is accomplished well before the construction of such databases. This normalization is preferably optimized for the speed of operation of the system, which may lead to a somewhat space inefficient layout. However, it is not necessary to optimize for speed, as it is possible to optimize database normalization for other desired effects, such as reduced size of the database and/or tables therein for faster data transfers.

As described herein, the embodiments of the present invention can provide an integral host unit that is self-contained during vehicle data sensing sessions and does not require a van or operator to be present during data capture. The invention also provides embodiments that provide secure and convenient retrieval of data and control of the unit. Furthermore, a software architecture has been disclosed that enables such integral host unit to accomplish the tasks that hardware of an integral host system is desired to accomplish in measuring information about passing vehicles.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A device that senses emissions from a vehicle using a communication network having a plurality of layers, the emission sensing device comprising:

a user information interface, said user interface being a part of an upper layer of the communication network;

a detector that detects information about a vehicle, said detector in communication with said user information interface and being a part of a lower layer of the communication network;

a processor in communication with the detector to receive the information from said detector and process the information, said processor being a part of a middle layer of the communication network; and a storage device that stores the information, said storage device in communication with said processor and being a part of said lower layer.

2. The device as recited in claim 1 wherein said middle layer comprises modules for processing the information wherein each module is a thread of varying priority.

3. The device as recited in claim 2 wherein one of said modules is a Component Object Model.

4. The device as recited in claim 2 wherein one of said modules is a Distributed Component Object Model.

5. The device as recited in claim 2, wherein modules that are identified as having a higher priority will be processed before other modules identified as having a lower priority.

6. The device as recited in claim 1 wherein said middle layer comprises a security system that prevents unauthorized access to the information.

7. The device as recited in claim 6 wherein said security system is within a Structured Query Language application.

8. The device as recited in claim 6 wherein said security system uses a smart card security validation system.

9. The device as recited in claim 1 wherein said middle layer comprises a replicator application that copies the information to an external device before the information is processed.

10. The device as recited in claim 1 wherein said lower layer comprises a Structured Query Language accessible database to store the information.

11. The device as recited in claim 10 wherein said database is normalized for efficiency.

12. A method for sensing emissions from a vehicle using a communication network having a plurality of layers, the emission sensing method comprising the steps of:

detecting information about a vehicle in a lower layer of the communication network;

storing the information in said lower layer;

processing the information in a middle layer of the communication network; and making the information available to users in an upper layer of the communication network.

13. The method as recited in claim 12 wherein said processing step further comprises the step of processing the information with modules wherein each module is a thread of varying priority.

14. The method as recited in claim 13 wherein at least one of said modules follows a Component Object Model paradigm.

15. The method as recited in claim 13 wherein at least one of said modules follows a Distributed Component Object Model paradigm.

16. The method as recited in claim 13, wherein said processing step further comprises the step of executing modules identified as having a higher priority before other modules identified as having a lower priority.

17. The method as recited in claim 12 wherein said processing step comprises the step of preventing unauthorized access to the information.

18. The method as recited in claim 12 wherein said processing step comprises the step of using Structured Query Language through an Active Data Object paradigm.

19. The method as recited in claim 12 wherein said processing step comprises the step of preventing unauthorized access using a smart card security validation system.

20. The method as recited in claim 12 wherein said step of storing further comprises the step of externally replicating the information from the lower layer before the information is processed, and further processing the replicated data externally.

21. The method as recited in claim 12 wherein said step of storing comprises the step of storing the information in a Structured Query Language accessible database.

22. The method as recited in claim 21 wherein said step of storing further comprises the step of normalizing the database for efficiency.

23. A system for sensing emissions from a vehicle using a communication network having a plurality of layers, the emission sensing system comprising the steps of:

a means for detecting information about a vehicle in a lower layer of the communication network;

a means for storing the information in a lower layer; a means for processing the information in a middle layer of the communication network; and a means for making the information available to users in an upper layer of the communication network.

24. The system as recited in claim 23 wherein said means for processing further comprises a temporary memory means for containing executable code and the information to be processed, with executable code organized in modules wherein each module is a thread of varying priority.

25. The system as recited in claim 24 wherein at least one of said modules is a reusable object in memory that has a common interface to other modules that use the object.

26. The system as recited in claim 24 wherein at least one of said modules is a reusable object in memory that can execute code from modules in external devices.

27. The system as recited in claim 24, wherein said means for processing further comprises a means for executing modules identified as having a higher priority before other modules identified as having a lower priority.

28. The system as recited in claim 23 wherein said means for processing comprises a means for preventing unauthorized access to the information.

29. The system as recited in claim 23 wherein said means for processing comprises a means for using a Structured Query Language constructs for processing the information.

30. The system as recited in claim 23 wherein said means for processing comprises a means for using a smart card security system for information access validation.

31. The system as recited in claim 23 wherein said means for storing further comprises a means for replicating the information from the lower layer before the information is processed externally.

32. The system as recited in claim 23 wherein said means for storing comprises a means for storing the information in a Structured Query Language accessible database.

33. The system as recited in claim 32 wherein said means for storing further comprises a means for normalizing the database for efficiency.

* * * * *